United States Patent [19]

Rampe

[11] 4,432,168

[45] Feb. 21, 1984

[54] FINISHING APPARATUS WITH IMPROVED DISCHARGE DOOR STRUCTURE

[75] Inventor: John F. Rampe, Mayfield Heights, Ohio

[73] Assignee: Rampe Research, Cleveland, Ohio

[21] Appl. No.: 262,552

[22] Filed: May 11, 1981

[51] Int. Cl.[3] ..... B24B 31/06

[52] U.S. Cl. ..... 51/163.1; 51/7

[58] Field of Search ..... 51/163.1, 163.2, 164 R, 51/7

[56] References Cited

U.S. PATENT DOCUMENTS

| | | | |
|---|---|---|---|
| 2,116,160 | 5/1938 | Rosenberger et al. | 51/163.1 |
| 3,318,051 | 5/1967 | Rampe . | |
| 3,337,997 | 8/1967 | Rampe . | |
| 3,449,869 | 6/1969 | Rampe . | |
| 3,694,968 | 10/1972 | Isaacson et al. | 51/163.1 |
| 3,831,322 | 8/1974 | Rampe . | |
| 3,871,136 | 3/1975 | Isaacson | 51/163.1 |
| 3,906,680 | 9/1975 | Rampe . | |
| 3,959,932 | 6/1976 | Rampe . | |

*Primary Examiner*—Harold D. Whitehead

*Attorney, Agent, or Firm*—David A. Burge

[57] ABSTRACT

A vibratory finishing machine includes a supporting frame, a processing tub, and a tub vibrating mechanism interposed between the frame and the tub. Workpieces and finishing media are introduced into the tub for processing, are vibrated to effect a finishing action, and are discharged from the tub through a discharge opening. The discharge opening is selectively opened and closed by a door structure which is not mounted on the tub for vibratory movement therewith as is conventional, but which is, instead, supported independently of the tub so that the tub vibrates relative to the door during finishing operations. The door is biased toward its closed position and is provided with a power-operated mechanism for moving it toward its open position. In the event of power failure, the biased door will move toward its closed position to prevent workpieces and finishing media from emptying from the tub.

12 Claims, 3 Drawing Figures

FINISHING APPARATUS WITH IMPROVED DISCHARGE DOOR STRUCTURE

CROSS-REFERENCE TO RELEVANT PATENTS

*Finishing Apparatus,* U.S. Pat. No. 3,318,051 issued May 9, 1967 to John F. Rampe, here the "Finishing Patent."

*Finishing Apparatus,* U.S. Pat. No. 3,337,997 issued Aug. 29, 1967 to John F. Rampe, here the "Orbital Patent".

*Vibratory Finishing Machine,* U.S. Pat. No. 3,449,869 issued June 17, 1969 to John F. Rampe, here the "Dual Shaft Patent."

*Continuous Feed Vibratory Finishing Machine With Discharge Rate Control By Operation of Tub Discharge,* U.S. Pat. No. 3,831,322 issued Aug. 27, 1974 to John F. Rampe, here the "Continuous Feed Patent."

*Finishing Apparatus With Improved End-of-Tub Liner and Door Structure,* U.S. Pat. No. 3,906,680 issued Sept. 23, 1975 to John F. Rampe, here the "Door Assembly Patent."

*Finishing System With Cyclically Operable Closure Control,* U.S. Pat. No. 3,959,932 issued June 1, 1976 to John F. Rampe, here the "Object Sensor Patent."

The disclosures of the foregoing patents are incorporated herein by reference.

BACKGROUND OF THE INVENTION

1. Field of the Invention

The present invention relates generally to finishing machines and, more particularly, to an improved discharge door structure for vibratory finishing machines.

2. Prior Art

Vibratory finishing machines adapted to smooth and finish the surfaces of workpieces by such operations as deburring, burnishing, descaling and cleaning are well known. Such machines commonly employ a movably mounted processing tub for receiving a quantity of workpieces and abrasive finishing media. A finishing action is imparted to the workpieces by vibrating the tub.

As is brought out in the referenced patents, finishing media can conveniently be separated from workpieces after the media and workpieces are discharged from the tub. After separation, the finishing media may then be returned to the tub of the finishing machine for reuse. The finished workpieces may be conveyed to a separate unit or to a group of units for washing, drying, inspecting and packaging.

One basic type of vibratory finishing machine employs a horizontally disposed receptacle which is vibrated by eccentrics rotated about axes substantially paralleling the length of the receptacle. This first type of machine is known in the art as a "tub-type machine," and its receptacle is commonly called a "tub." A second type of machine employs an annular receptacle disposed in a substantially horizontal plane, and one or more eccentrics which vibrate the receptacle about a vertical axis located substantially centrally of the receptacle. This latter type of machine is known in the art as a "bowl-type machine," and its receptacle is often referred to as a "bowl". While the present invention is particularly well suited for use with tub-type machines, it may also be utilized with other types of finishing machines. Accordingly, it will be understood that neither the example given later in this patent of the practice of the invention in conjunction with a tub-type machine, nor use of the term "tub" in describing a machine receptacle is intended to limit the scope of the invention to use on tub-type machines.

Tub-type machines are often categorized as being either of the batch-type or of the continuous-feed-type. Some tub-type machines can be operated selectively in either batch-type or continuous-feed-type modes. In batch-type operation, the machine is loaded, a finishing operation is carried out, and the machine is them emptied. In continuous feed operation, media and workpieces are introduced into the tub near one end are finished as they precess in a churning-type movement along the length of the tub, whereupon they discharge together with the finishing media through a discharge opening at the opposite end of the tub. The present invention is operative with either batch-type or continuous-feed-type machines, or with finishing machines operated in either batch-type or continuous-feed-type modes.

The referenced Continuous Feed Patent, Object Sensor Patent, and Door Assembly Patent describes tub-type machines which are provided with discharge systems for controlling the rate at which a mixture of workpieces and finishing media discharges during a continuous-feed operation; while these machines may be operated on a batch-type basis if desired, they are designed primarily for continuous-feed operation wherein their discharge closures are opened and closed periodically to provide a controlled discharge of workpieces and media. The cycle of closure operation establishes an effective rate at which workpieces and media discharge from the tub which, in turn, determines the time span during which workpieces are retained in the finishing tub.

While the several referenced patents describe various types of closure systems for selectively opening and closing a discharge opening, a common drawback of each of these arrangements is that its discharge closure and operating mechanism are mounted on the machine's tub for movement therewith as the tub is vibrated. Since the discharge door and its operating mechanism are vibrated with the tub, these components must be built to withstand continuous vibration extending over a period of many years. This necessitates that the components be formed from relatively heavy materials which are precisely machined and sturdily bearinged to assure operational longevity.

A further drawback of mounting a discharge door and its operating mechanism on a vibratory finishing machine tub is that these components add weight to the tub and therefore require that the eccentrics which are vibrating the tub impart a greater amount of energy to the tub to effect its vibration. Moreover, where a door and its operating mechanism are mounted on a tub, these relatively heavy components may make it more difficult to vibrate the tub in a balanced, uniform fashion.

Still another problem with some previously proposed discharge closure systems is that, in order to effect mounting of the discharge closure and its operating mechanism on the tub, and in order to minimize the weight of these components, the discharge opening is often caused to be restricted in size beyond that which is desired. A further problem arising where efforts are made to minimize the weight of a discharge door and its operating mechanism is that the length of the path along which the door travels during opening and closing is kept as short as possible, whereby the door, when fully open, may still be found to at least slightly interfere with discharge of workpieces and finishing media from the tub. In short, design constraints imposed by the mounting of a discharge door and its operating mechanism on a vibratory finishing machine tub have, in some instances, prevented the type of full and free discharge of contents from the tub that is often desired.

SUMMARY OF THE INVENTION

The present invention overcomes the foregoing and other drawbacks of prior proposals by providing a novel and improved discharge control system for a vibratory finishing machine including a movable door and a door operating mechanism, neither of which is mounted on the tub of the machine. In accordance with the improvement of the present invention, a discharge door and its operating mechanism are mounted on a supporting frame which remains stationery during vibration of the machine's tub.

The door system of the present invention represents a significant improvement over prior proposals in several important respects. Inasmuch as the door and its operating structure are not mounted on a vibrating tub, the door and its operating mechanism are subjected to much less vibration and can be formed less expensively while actually increasing the operational longevity of these components. Since the weight and arrangement of the door and its operating mechanism no longer appreciably affect the balance and vibrational characteristics of the tub, tub balance is easier to maintain, the tub can be vibrated with a lesser degree of drive force, and a door of larger size, opening through a longer path of travel can be employed to permit a much less obstructed discharge of contents from the tub.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 1:
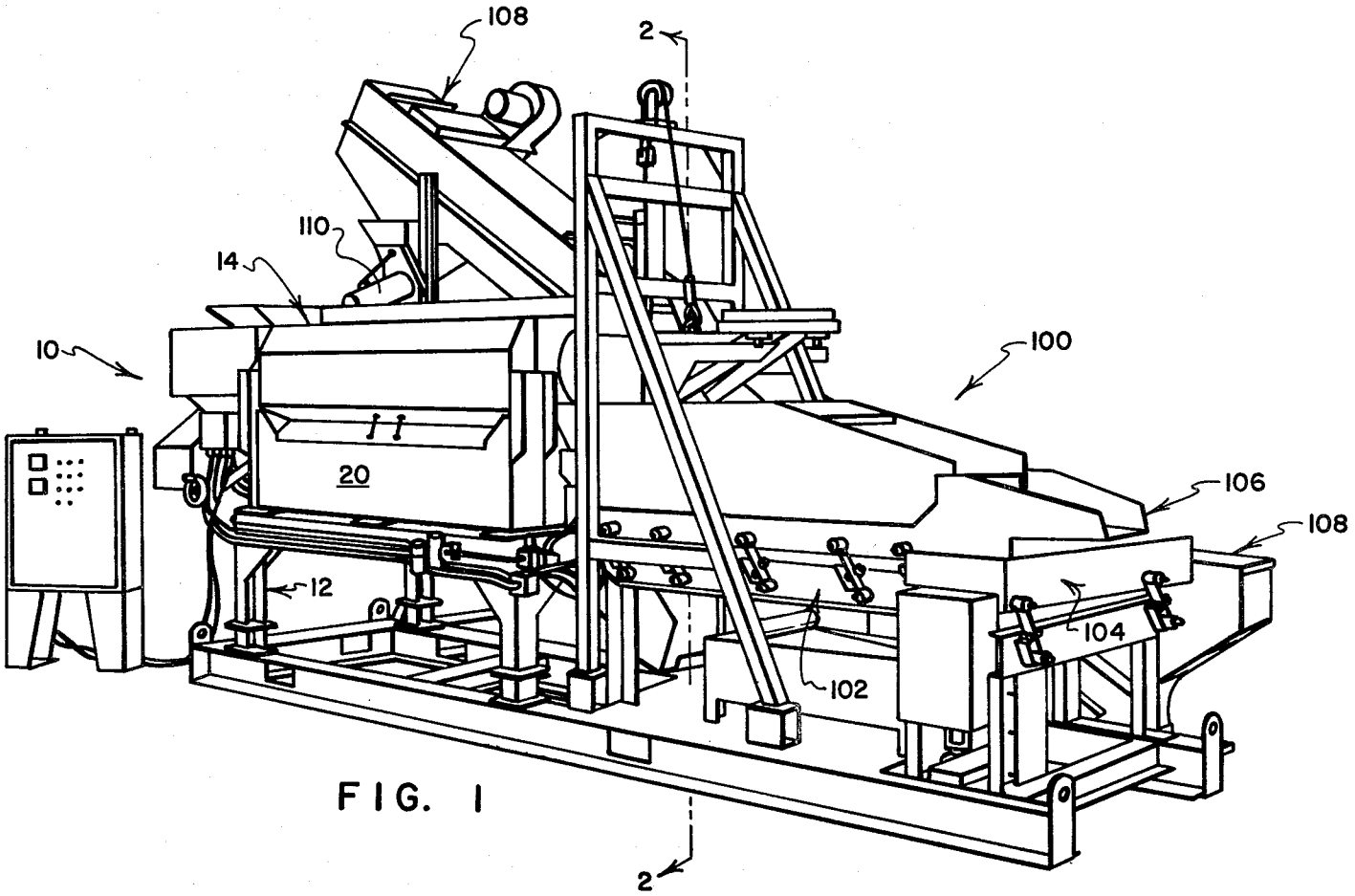
FIG. 1 is a perspective view of a vibratory finishing machine employing a discharge door structure embodying the preferred practice of the present invention.

Referring to FIG. 1, a vibratory finishing machine of the tub-type is indicated generally by the numeral 10. The machine 10 includes a supporting frame structure 12 and a tub structure 14 mounted thereon for vibratory movement.

In the manner described in the referenced patents, the disclosures of which are incorporated herein by reference, a plurality of resilient elastomeric mounts (not shown here) are interposed between the structures 12, 14 to permit the tub structure 14 to vibrate relative to the frame structure 12, and a vibratory drive system (not shown here) is provided to vibrate the tub structure 14. The drive system includes rotatable eccentrics (not shown here) extending along opposite sides of the tub structure 14, and covered by elongate housings of the type indicated by the numeral 20.

Figure 3:
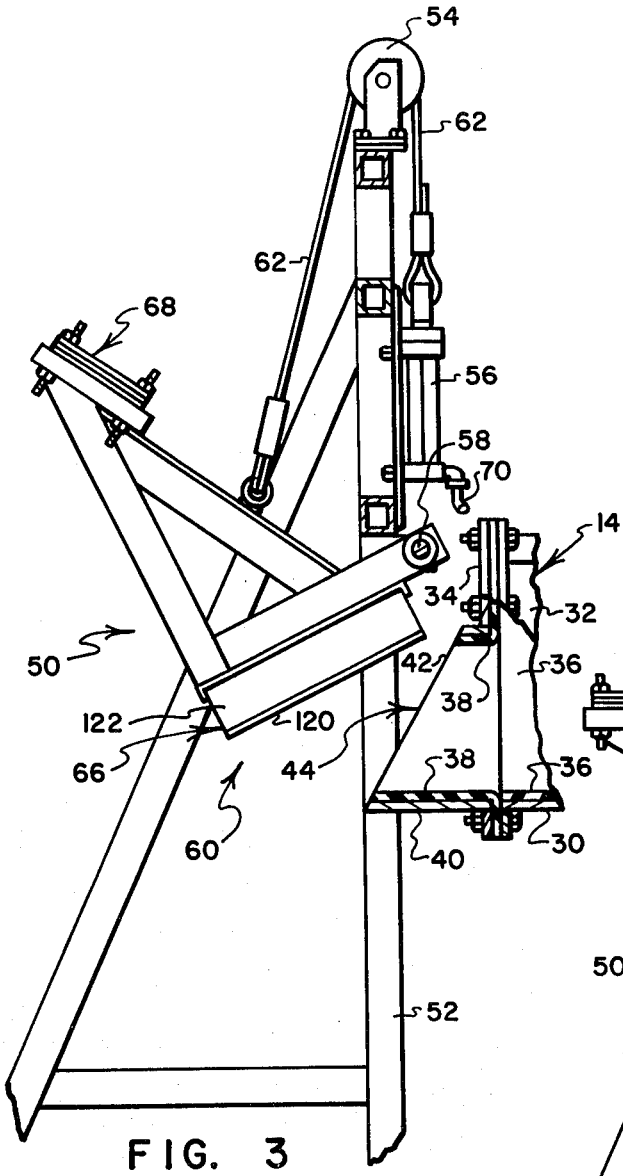
FIG. 3 is a sectional view similar to FIG. 2 but showing the door in its open position, the view further differing from FIG. 2 in its showing of portions of the tub structure of the vibratory finishing machine being further broken away.
Figure 2:
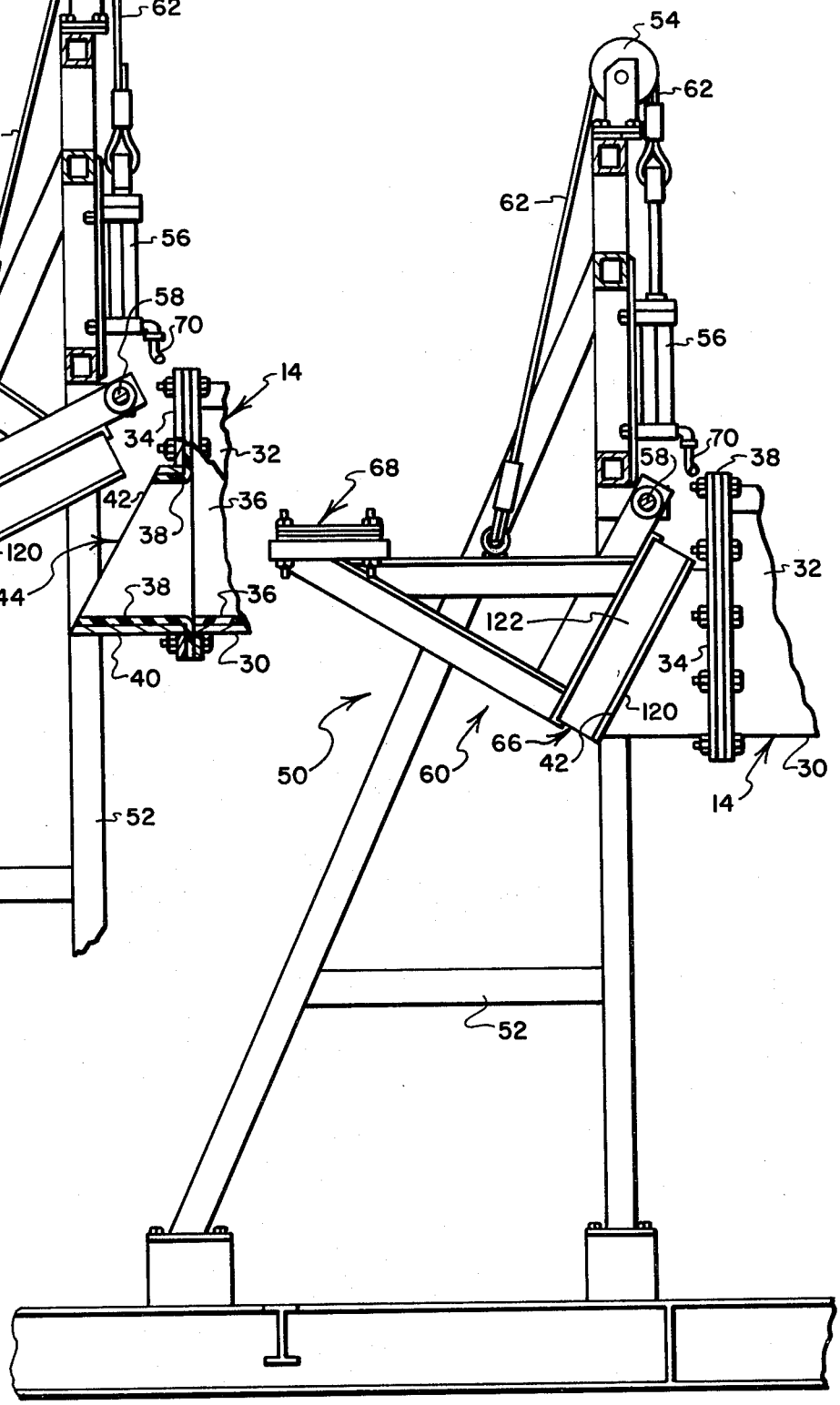
FIG. 2 is a sectional view as seen from a plane indicated generally by a line 2—2 in FIG. 1, this view showing the door in its retaining position.

The tub structure or tub 14 is of the type described in the referenced Dual Shaft Patent. Referring to FIGS. 2 and 3, the tub 14 has a bottom wall portion 30 and upstanding side wall portions 32 which cooperate to define an elongate, generally U-shaped trough into which workpieces and finishing media may be deposited for finishing. An end plate 34 closes one end of the tub 14.

Inwardly facing surfaces of the wall portions 30, 32 are covered with a resilent layer of tub lining material 36, as is described in the referenced Tub Liner Patent. The inwardly facing surface of the end plate 34 is covered by a sheet of tub lining material 38, as is described in the referenced Door Assembly Patent.

The end plate 34 carries a discharge spout 40 which communicates with the tub 14 at a location in alignment with the bottom of the tub 14 so that media, finished workpieces, and such other materials as may be present in the tub 14 may be discharged without obstruction. The liner sheet 38 lines the inner surfaces of the spout 40. The outer end of the discharge spout 40 has end surfaces 42 which lie in a common plane and define a discharge opening 44.

In accordance with the preferred practice of the present invention, a door assembly indicated generally by the numeral 50, is provided for selectively permitting workpieces and finishing media to discharge from the tub 14 through the opening 44. The door assembly 50 includes an upstanding frame 52 which rotatably supports a pulley 54 near its upper end. A pneumatic cylinder 56 is supported on the frame 52 at a location beneath the pulley 54. A shaft 58 pivotally mounts a door structure 60 on the frame 52 at a location beneath the pneumatic cylinder 56. A cable 62 is reeved around the pulley 54 and has its opposite ends connected to the pneumatic cylinder 56 and the door structure 60.

A closure member 66 is mounted on the door structure 60 for movement along a path of travel between a retaining position, shown in FIG. 2, and an open position, shown in FIG. 3. A weight assembly 68 is carried by the door structure 60 and serves to bias the closure member 66 toward its retaining position. The pneumatic cylinder 56 is operable, when supplied with pressurized air through a hose 70, to pivot the door structure 60, in opposition to the biasing action of the weight assembly 68, toward and to its open position. In the event of a failure of supply of pressurized air to the cylinder 56 (i.e., in the event of a power failure) at a time when the cylinder 56 has moved the closure member 66 out of its retaining position, the biasing action of the weight assembly 68 will return the closure member 66 to its retaining position.

When the closure member 66 is in its retaining position, as shown in FIG. 2, workpieces and finishing media are prevented from discharging from the discharge opening 44. When the closure member 66 is in its open position, as shown in FIG. 3, workpieces and finishing media are permitted to discharge in an unobstructed fashion through the opening 44.

Referring to FIG. 1, the machine 10 includes a conventional vibratory screener and conveyor system, indicated generally by the numeral 100, for separating workpieces from finishing media, and for returning finishing media to the tub structure 14. As will be understood by those skilled in the art, the door structure of the present invention can be used with finishing machines having no conveyor system 100 associated therewith. Inasmuch as the system 100 is conventional in nature and non-essential to the use of the present invention, it will be described only briefly.

The system 100 includes a vibratory screener unit 102 which receives the mixture of workpieces and finishing media which discharges from the tub structure 14 through the opening 44. The mixture is vibratorily conveyed across a screen (not shown), through which the pieces of finishing media pass for discharge into a vibratory conveyor 104, and across which the workpieces are conveyed for discharge from a spout 106 into a suitable container (not shown). The finishing media delivered to the vibratory conveyor 104 is conveyed into the lower end of a belt conveyor 108 and is returned by the conveyor 108 through a spout 110 to the tub structure 14.

While one might expect that a door carried independently of a vibratory tub might be subjected to excessive wear as the tub discharge spout moves relative to the door during operation of the machine, it has been found that by lining the door with a relatively rigid outer surface skin 120 (see FIGS. 2 and 3) of urethane supported on a pad 122 of closed cell polyurethane foam will give a surprisingly long-lived structure.

As will be apparent from the foregoing description, door structures embodying the present invention are mounted on a framework which does not vibrate with the machine of the tub, and therefore do not disturb the operation or affect the balance of the tub, and need not be made to withstand the severe vibrations that are encountered where a door structure is mounted directly on a vibrating tub as has been conventional. Inasmuch as the size and weight of the door and its operating mechanism do not influence the operation and balance of the tub, a door of larger size opening through a longer path of travel can be utilized. Moreover, the tub can be driven with a lesser expenditure of energy inasmuch as its weight does not include the weight of a door and its operating mechanism.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A vibratory finishing machine, comprising:

(a) a frame structure;

(b) a vibratory tub structure carried on the frame structure but free to vibrate relative to the frame structure;

(c) means for vibrating the vibratory tub structure relative to the frame structure for imparting a vibratory finishing action to such workpieces and finishing media as may be inserted into the vibratory tub structure;

(d) the vibratory tub structure having portions which vibrate with the vibratory tub structure and which define a discharge opening through which workpieces and finishing media may discharge from the vibratory tub structure; and, (e) discharge means for selectively permitting and preventing discharge of workpieces and finishing media from the vibratory tub structure through the discharge opening including:

(i) a closure member movable along a path of travel between an open position wherein workpieces and finishing media are permitted to discharge in a substantially unobstructed manner from the discharge opening, and a retaining position substantially adjacent the discharge opening of the vibratory tub structure wherein the closure member extends entirely across the discharge opening and serves to retain workpieces and finishing media within the vibratory tub structure when the vibratory tub structure is moving relative to the closure member during operation of the machine; and, (ii) mounting means, separate from said frame, mounting the closure member for movement along said path of travel and supporting the closure member so that it does not move with the vibratory movements of the vibratory tub structure.

2. The vibratory finishing machine of claim 1 wherein the mounting means pivotally mounts the closure member for movement along said path of travel.

3. The vibratory finishing machine of claim 1 wherein the discharge means additionally includes closure operator means for moving the closure member along said path of travel.

4. The vibratory finishing machine of claim 1 wherein the discharge opening is defined by wall portions of the vibratory tub structure which extend in a substantially common plane whereby the discharge opening is defined to extend within said common plane, and the closure member has a generally planar surface which, when the closure member is positioned in its retaining position extending across the discharge opening, extends in a plane substantially parallel to said common plane.

5. The vibratory finishing machine of claim 1 additionally including biasing means biasing the closure member toward its retaining position.

6. The vibratory finishing machine of claim 5 wherein the biasing means includes a weight connected to the closure member and being arranged to move in a downward direction when the closure member moves from its open position toward its retaining position, whereby the influence of the force of gravity operating on the weight serves to bias the closure member toward its retaining position.

7. The vibratory finishing machine of claim 5 additionally including power-operated means for moving the closure member from its retaining position toward its open position.

8. The vibratory finishing machine of claim 7 wherein the power-operated means and the biasing means are arranged such that, in the event of a failure of power to the power-operated means, the biasing means will function to move the closure member toward its retaining position.

9. The vibratory finishing machine of claim 1 wherein the discharge means additionally includes:

(a) an upstanding frame;

(b) mounting means movably mounting the closure member on the upstanding frame; and, (c) weight means for biasing the closure member toward its retaining position.

10. The vibratory finishing machine of claim 9 wherein the mounting means pivotally couples the closure member to the upstanding frame for arcuate movement along said path of travel.

11. The vibratory finishing machine of claim 9 wherein the weight means is rigidly coupled to the closure member for movement therewith.

12. The vibratory finishing machine of claim 9 wherein the discharge means additionally includes:

(a) power-operated means for effecting movement of the closure member along said path of travel toward and to its open position;

(b) a pulley supported on the upstanding frame; and, (c) a flexible cable reeved around the pulley and drivingly interconnecting the power-operated means and the closure member.

* * * * *